United States Patent [19]

van Heel

[11] 4,302,406

[45] Nov. 24, 1981

[54] APPARATUS FOR HEATING WATER IN A RESERVOIR

[75] Inventor: Joannes M. van Heel, Zevenbergen, Netherlands

[73] Assignee: Stichting Bouwcentrum, Zevenbergen, Netherlands

[21] Appl. No.: 160,626

[22] Filed: Jun. 18, 1980

[30] Foreign Application Priority Data

Jun. 29, 1979 [NL] Netherlands ..... 7905100

[51] Int. Cl.[3] ..... B01F 3/04

[52] U.S. Cl. ..... 261/124; 210/169; 210/220; 237/56; 239/145; 239/269; 261/121 R

[58] Field of Search ..... 261/121 R, 122, 124, 261/141, DIG. 47; 4/542, 543; 210/169, 220; 239/145, 269, 450; 237/56, 58, 59; 128/66

[56] References Cited

U.S. PATENT DOCUMENTS

| | | | |
|---|---|---|---|
| 435,856 | 9/1890 | Parker | 261/141 |
| 2,218,635 | 10/1940 | Borge | 261/122 |
| 2,483,561 | 10/1949 | Rauh | 261/122 |
| 2,502,187 | 3/1950 | Wahlgren | 261/122 |
| 2,805,846 | 9/1957 | Dewan | 261/121 R |
| 4,006,205 | 2/1977 | Etter | 261/122 X |
| 4,022,655 | 5/1977 | Gavditz et al. | 261/121 R X |
| 4,048,072 | 9/1977 | McCullough | 261/122 X |
| 4,215,082 | 7/1980 | Danel | 261/122 X |

*Primary Examiner*—Richard L. Chiesa

*Attorney, Agent, or Firm*—Daley & Brandt

[57] ABSTRACT

Apparatus for heating water in a reservoir, comprising a pipe system including at least one supply conduit, at least part of which pipe system is disposed in the vicinity of the surface of the water in the reservoir, means for supplying hot air through the supply conduit to the pipe system, a plurality of open-ended tubules of flexible material or hoses being secured in spaced relationship to the pipes of the pipe system, the open ends of which tubules or hoses are located under the water surface.

4 Claims, 4 Drawing Figures

APPARATUS FOR HEATING WATER IN A RESERVOIR

This invention relates to an apparatus for heating water in a reservoir.

There are many possibilities of heating water in a reservoir, e.g. a swimming pool. It is an object of the present invention to provide a new apparatus for heating water by means of hot air. The hot air required for heating the water can be provided in any suitable manner. In particular, however, the present invention aims to provide an apparatus for heating water in a reservoir by means of hot air produced with the help of solar collectors. Possible applications are covered or semi-covered swimming pools, with at least part of the cover being constituted by collectors in which air is heated by sun rays falling on the collectors.

According to the present invention, there is provided an apparatus comprising a pipe system including at least one supply conduit, at least part of said pype system being disposed in the vicinity of the surface of the water in the reservoir, means for supplying hot air by way of the supply conduit or supply conduits to said pipe system, a plurality of open-ended tubules of flexible material or hoses being attached in spaced relationship to the pipes of the pipe system which are disposed in the vicinity of the water surface, the open ends of said tubules or hoses being located under the water level, and which flexible tubules or hoses are such that, in operation, when hot air is blown into the pipe system and discharged by way of the tubules or hoses, an equilibrium situation arises between each tubule or hose and the surrounding water, in which the open end remains fully under the water level.

The pipe system of the apparatus according to the invention may be constructed in known manner, e.g. including conduits or pipes of thin metal sheet of the type used in air-conditioning installations, or with plastics tubes. The tubules of flexible material or hoses which in the apparatus according to the invention are secured to the pipes of the pipe system are formed, for example, of rubber or synthetic plastics material. The material of the pipes and of the tubules must at any rate be suitable for use in or in the vicinity of water, and be suitable for high temperatures. The air to be blown through them may under circumstances be very hot. Preferably, the flexible tubules or hoses according to the invention are provided at the open ends with weighting means. The weighting means may suitably consist of a ring of a relatively heavy material around, and fixedly connected to, the open end. The object of such weighting means is to ensure that, in operation, when air is forced through the pipe system and via the flexible tubules into the water, the upward pressure exercised by the air on the tubules is counteracted by the weight of the end to the extent as to provide an equilibrium condition in which the open end of the tubules just remains "floating" under the water level. Water waves will be followed by the floating end of the tubules. Consequently, the ends of the tubules constantly remain just under the water level.

In operation, hot air is forced through the apparatus for example by means of a blower. The hot air can be supplied in any suitable manner. In particular, the hot air can be produced by heating air with solar energy in a collector. The hot air is blown through the apparatus according to the invention into the water and bubbles upwards through it to the water surface. During this movement heat is delivered to the surrounding water. Currents occurring naturally or to be created artificially in the water will transport the heat further and ultimately all of the water in the reservoir will be increased in temperature. As the tubules through which the hot air is blown into the water terminate closely under the surface of the water, a blower having a relatively low capacity will suffice for blowing the air through the system. This makes for economic operation.

One embodiment of the invention will now be described, by way of example, with reference to the accompanying drawings, in which.

Figure 1:
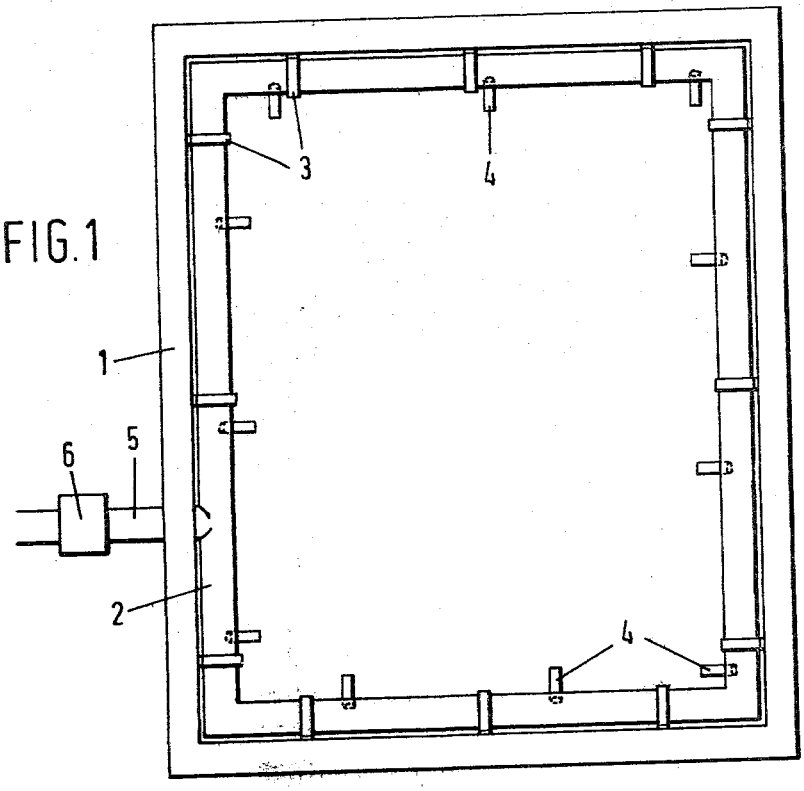
FIG. 1 is a diagrammatic plan view of an embodiment of the apparatus according to the invention, mounted in a water reservoir.

FIG. 1 is a diagrammatic plan view of a possible embodiment of the apparatus according to the invention, used in a rectangular water reservoir. The rectangular water reservoir has upright walls 1, made for example of concrete. Mounted in the water reservoir is a pipe system 2 built up from a plurality of interconnected pipes which follow the form of the water reservoir. The pipes of pipe system 2 are secured to walls 1 by means of clamps 3. Secured to the underside of pipe system 2, in relatively uniformly spaced relationship, are flexible tubules or hoses 4. In FIG. 1, tubules 4 are shown in the operative position, which will be described in more detail hereinafter.

Connected to pipe system 2 is a supply conduit 5, which includes a blower 6. In operation, hot air supplied to supply conduit 5 will be blown into pipe system 2 by means of blower 6, and leave the system 2 through tubules 4.

Figure 2:
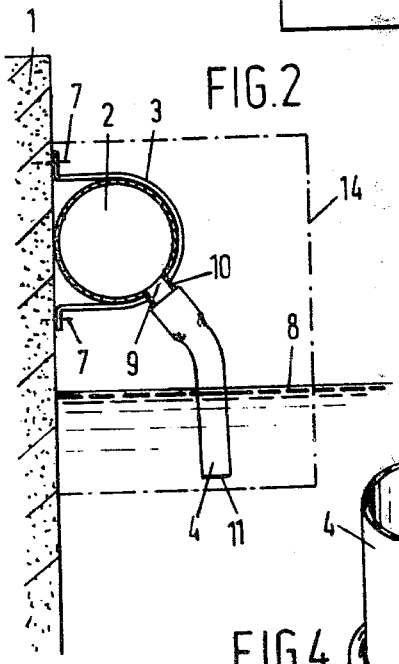
FIG. 2 is a cross-sectional view, showing a portion of the apparatus according to the invention at a moment when the apparatus is out of operation.
Figure 3:
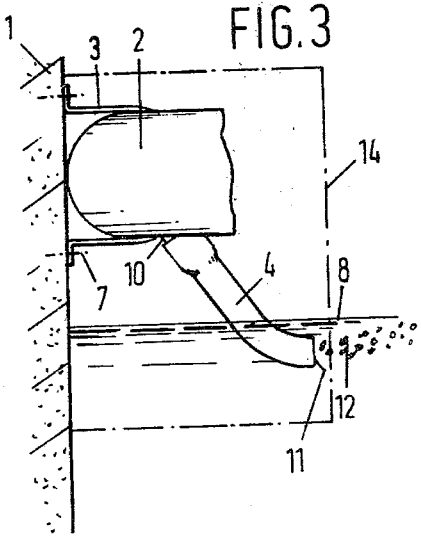
FIG. 3 is a view similar to FIG. 2, but now during operation of the apparatus.

The apparatus according to the invention is arranged in a water reservoir so that the pipes of pipe system 2 are disposed close to the water surface in the reservoir. FIGS. 2 and 3 illustrate a cross-sectional view of the apparatus according to the invention. They show how a pipe of the pipe system 2 is secured by means of a clamp 3 to a wall 1 of the reservoir. FIGS. 2 and 3 show a pipe 2 having a circular cross-sectional configuration, which is secured to wall 1 by a U-shaped clamp. Clamp 3 is secured to wall 1, for example, by means of screws 7. The cross-sectional configuration of tubes 2 is not essential. Instead of pipes of a circular section, for example, pipes of rectangular section may be used, in which case one would preferably use bent clamps matching the shape of the pipes. As shown in FIGS. 2 and 3, pipe 2 is spaced a small distance from the water surface 8 in the water reservoir.

Secured to the underside of pipe 2 is a flexible tubule or hose 4. For this purpose, pipe 2 may be provided with an aperture 9, around which there is provided a collar 10. Tubule 4 is now shifted onto collar 4 and sealingly connected with it in a flexible manner, for example, by means of a suitable adhesive or by a clamp. The flexible tubule or hose 4 has a length such that its open end 11, which may be weighted in a suitable manner, is below the water surface 8. If the apparatus is not in operation, the flexible tubule will depend downwardly, as shown in FIG. 2, and the water will have the same level within and without the tube.

FIG. 3 shows what happens when the apparatus is in operation. In operation, air is blown into pipes 2 and through pipes 2 into the tubules or hoses 4. Owing to the buoyant force of the air, the lower end of each tubule 4 will be curved in the direction of the water surface 8. Owing to the weight of that part of the tubule and the possible weighting means provided at the open end, the tube 4 is pulled downwardly. An equilibrium condition will result. The operating conditions (quantity of air forced through the tubules per unit of time, and the temperature of the air) and the nature of the tubules (material, and hence their own weight, and flexibility and size of weighting means, if any is provided) should be pre-selected in such a manner that, in operation, the open ends of tubes 4 remain just below the surface 8 of the water. Owing to the flexibility of the tubules, the open ends remain just below the water surface, even during wave movements of the water. In the case of a wave movement, this will be followed by the ends of the tubules to a certain extent.

By virtue of the fact that, as shown in FIGS. 2 and 3, the hoses 4 are applied not just in the middle under tube 2, but slightly to the side, a certain blowing direction will be ensured during operation. When tubules 4 are secured in the places indicated in the figures, when air is blown through them the hoses will be curved into a direction away from the wall of the reservoir.

The air forced through pipes 2 and tubules 4 leaves the tubules 4 through their open ends 11 and moves to the water surface 8 in the form of air bubbles 12 (FIG. 3). Even during the short time when the air moves through the water, virtually all heat will be delivered to the surrounding water. As a result, the water will be locally heated. Owing to currents occurring in the water or deliberately created therein, the heat will be distributed further in the water reservoir. If the water reservoir is a swimming pool, such currents will be provided as a result of the water in swimming pools being commonly pumped round continuously for it to be passed through filters.

The pipe system 2 with the hoses 4 may be surrounded in a suitable manner by a protective cage 14, made for example of wire netting. Such a cage 14 prevents that, in the case of a swimming pool, swimmers can touch and damage the pipe system 2 and the hoses 4.

Figure 4:
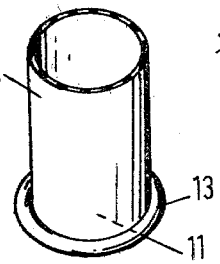
FIG. 4 illustrates the open end of a flexible tubule or hose for use in the apparatus according to the invention.

FIG. 4 shows how possible weighting means at the end of a tubule 4 may be realized. In this case the weighting means consists of a ring 13, for example of metal, provided around the open end 11 of tubule 4 and fixedly connected to it. A possible connection between ring 13 and tubule 4 can be realized with a tubule of synthetic plastics material, for example, by the ring being embedded within the synthetic plastics material. In the case of a rubber tubule, the ring may be secured to the end by vulcanizing.

The number of hoses or tubules 4 which with a given reservoir must be secured to pipes 2, and also the interspace between the tubules can be determined in practice by experimentation. The number and interspace will depend for one thing on the temperature of the air and the amount of hot air that can be blown through the system.

Although a system comprising one supply conduit and one blower is shown hereinbefore, it will be clear that the apparatus according to the invention may as well be provided with a plurality of such feed units.

I claim:

1. Apparatus for heating water in a reservoir comprising a closed pipe system encircling at least part of the expanse of the reservoir interiorly thereof and said pipe system being disposed above but adjacent the water surface, an air supply conduit in communication with said pipe system, there being embodied therewith means for supplying heated air to said supply conduit for communication thereof to said pipe system, said pipe system having a plurality of outlets spaced therealong and said outlets facing downwardly angularly toward the surface of said water, and a corresponding plurality of flexible hoses connected at one end to each outlet, each said hose in the absence of air flow therethrough extending downwardly into the water with the other end thereof submerged below the surface of said water, said hoses distending when air flows therethrough, the weight of said hoses establishing an equilibrium condition countering the buoyant effect of such air flow to maintain the said other ends of said hoses adjacent to but below said water surface.

2. The apparatus of claim 1 in which said pipe system includes nipple-like collars at each such outlet, the said one ends of said hoses being connected to said collars.

3. The apparatus of claim 1 further comprising weight means carried at the said other ends of said hoses.

4. The apparatus of claim 3 in which said weight means comprises a ring of material heavy relative to said hoses and fixedly connected to said other ends of said hoses.

* * * * *

UNITED STATES PATENT AND TRADEMARK OFFICE

CERTIFICATE OF CORRECTION

PATENT NO. : 4,302,406

DATED : November 24, 1981

INVENTOR(S) : Joannes M. Van Heel

It is certified that error appears in the above—identified patent and that said Letters Patent is hereby corrected as shown below:

On the title page, Assignee address should read

-- Rotterdam, Netherland --.

Signed and Sealed this

*Eighth* Day of *June 1982*

[SEAL]

*Attest:*

GERALD J. MOSSINGHOFF

*Attesting Officer*

*Commissioner of Patents and Trademarks*